United States Patent [19]

Unger

[11] 4,268,061

[45] May 19, 1981

[54] SKI BRAKE

[76] Inventor: Paul Unger, Bruckwiesenstr. 113, Altenberg b. Nurnberg, Fed. Rep. of Germany, D.8501

[21] Appl. No.: 69,897

[22] Filed: Aug. 27, 1979

[30] Foreign Application Priority Data

Aug. 30, 1978 [DE] Fed. Rep. of Germany ..... 2837787

[51] Int. Cl.[3] ..... A63C 7/10

[52] U.S. Cl. ..... 280/605

[58] Field of Search ..... 280/605, 604, 12 AA, 280/12 AB

[56] References Cited

FOREIGN PATENT DOCUMENTS

| | | | |
|---|---|---|---|
| 2118849 | 12/1971 | Fed. Rep. of Germany | 280/605 |
| 2430812 | 1/1975 | Fed. Rep. of Germany | 280/605 |
| 2635155 | 2/1978 | Fed. Rep. of Germany | 280/605 |
| 2228506 | 5/1973 | France | 280/605 |
| 2302115 | 2/1975 | France | 280/605 |

*Primary Examiner*—David M. Mitchell
*Assistant Examiner*—Michael Mar

[57] ABSTRACT

A ski brake including a guard-bar pivotable on stub shafts that are spaced from the heel grip with abutment surfaces provided to actuate similar spaced coil springs to allow for the pivot action.

2 Claims, 3 Drawing Figures

SKI BRAKE

Figure 1:
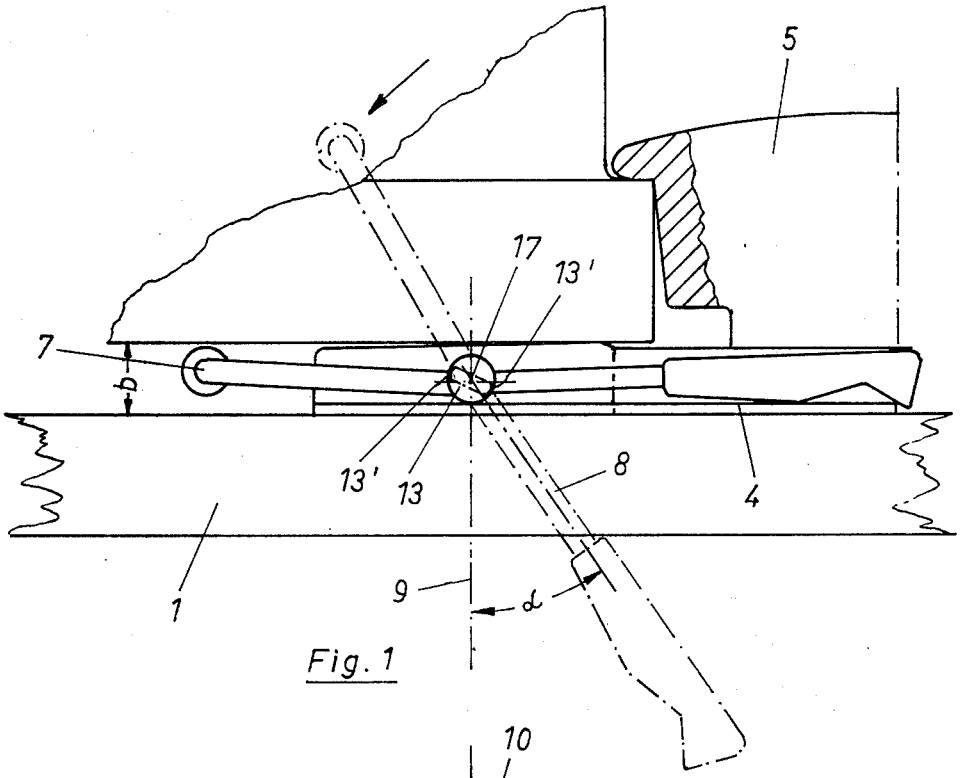

The invention involves a ski brake with a roughly U-shaped swivel-action guard-bar hinged to the ski around a level axis perpendicular to the length of the ski. Springs are compressed by the ski boot as it is placed on the ski in the direction of motion. When the boot is pried loose from the ski the coils are released, so swiveling the guard-bar as to extend its arms beneath the underside of the ski—the braking position. This is accomplished by means of a plate screwed in place on the ski, essentially covering the entire width of the ski, and via torsion rod springs providing a swivel-action anchor for the guard-bar. The torsion rod springs have to extend across the entire width of the ski. They also hold down the ski boot rather tightly in the go position, whereas in the braking mode they deliver only a modicum of braking power since the torsion springs are at rest in the latter position. The powerful hold-down force brought to bear in the go position not only hampers the skier but also and above all negatively impinges on the release performance of the binding with which it is linked. In other words, it hinders release in the event of a so-called torsion fall because the increased pressure exerted by the boot brings about greater frictional drag between the boot sole and the bridge of the braking guard-bar. The release performance of the heel grip also suffers since the effective release force is cut down. Further, in the case of the familiar ski brake there is the fact that the latter has to be installed rather far from the heel grip, i.e. close to the toe-iron. The result is that in connection with the increased frictional drag already described, an additional impediment to sideway or torsion release of the boot is created.

The challenge posed by the invention, in the face of all this, is that of devising an ice-up-proof ski brake of simple design which will do much to cope with what there is now about the ski brake that restrains or rather renders more difficult torsion or sideway release as well as what hampers vertical release, while it will achieve maximum possible braking power in the braking position.

To accomplish this task what is first proposed in the case of a ski brake of the type referred to at the outset, is the following: The guard-bar arms should be so joined via a shaft, or, alternatively, they should each be so joined to a shaft stub that they will be torsion-resistant. A holding device should be attached to the ski or to the heel grip, wherein the shaft or the shaft stubs should have one or more abutment surfaces for one or more springs that, on the one hand, would take hold on the abutment surface or surfaces and, on the other, would take hold on the holding device. The abutment surface or surfaces would have to be set an an angle to the guard-bar arms such as to have the coils move the guard-bar into the braking position. In the case of the shaft-stud design possibility the stubs can be kept relatively short. This would ensure that between the holding devices to be affixed at the sides of the ski surface or in the standing ridges of the releasing heel grip there is enough room to allow sufficient play to the stepping-spur of the heel grip between these holding devices or the standing ridges. If desired, the entire heel grip could be pushed in between these holding devices. This concept is based chiefly on the idea of releasing heel grips that can be adjusted in relation to a supporting plate in the direction of the length of the ski to adapt to different shoe sizes. In the case of the design option using a shaft the coils required to produce spring tension could all be affixed on that side of the shaft which runs from said shaft forward in the directon of the toe-iron. Thus, there is still enough room left between the shaft and the heel grip to allow for introduction of the stepping-spur. In line with the invention, this arrangement further distinguishes itself by being immune to ice-up, simple in design and very low in construction profile. The height attained by the unit installed is very insignificant, especially in the case of the shaft-based design. The reason is that the latter allows for housing a greater number of coils, meaning that each coil need only have correspondingly little bulk. The bulk of the springs, of course, in turn has decisive bearing on just how high the installed unit rises.

A ski brake doing justice to the invention thus can advantageously be placed in the area of the heel grip or even be put right on the swivel-up casing of the latter or just ahead of the heel grip on the ski. This would create a correspondingly wide margin between the guard-bar bridge, on which the boot rests in the go position, and the toe-iron. The result would be to cut down on the hampering effect which the friction between the boot and the guard-bar bridge has on sideway and vertical release in comparison with the familiar ski brake described at the outset.

One of the preferred design options embodying the invention is the one wherein the spring or springs is/are arranged in the form of (a) pressure spring(s) braced against the holding device and, via an intermediary piece, press(es) down especially on the abutment surface or surfaces of the shaft or shaft stubs. This proposal stands out not only in terms of its simplicity of construction but also excels in view of the fact that in the braking position the actually effective leverage between the abutment surface and the spring or the intermediary piece is at its peak—the same being true also of the torque applied to the guard-bar—thus yielding optimal braking power. Conversely, the more the guard-bar is swiveled in the direction of the go position, the less torque there is. This explains why a ski brake faithfully reflecting the invention would manage in the go position to make do with less boot pressure on the guard-bar than the familiar ski brake. Not only does this make things easier for the skier, but it also contributes further to lessening the frictional drag between boot and guard-bar in the go position and, by the same token, to rising to the challenge posed.

Figure 2:
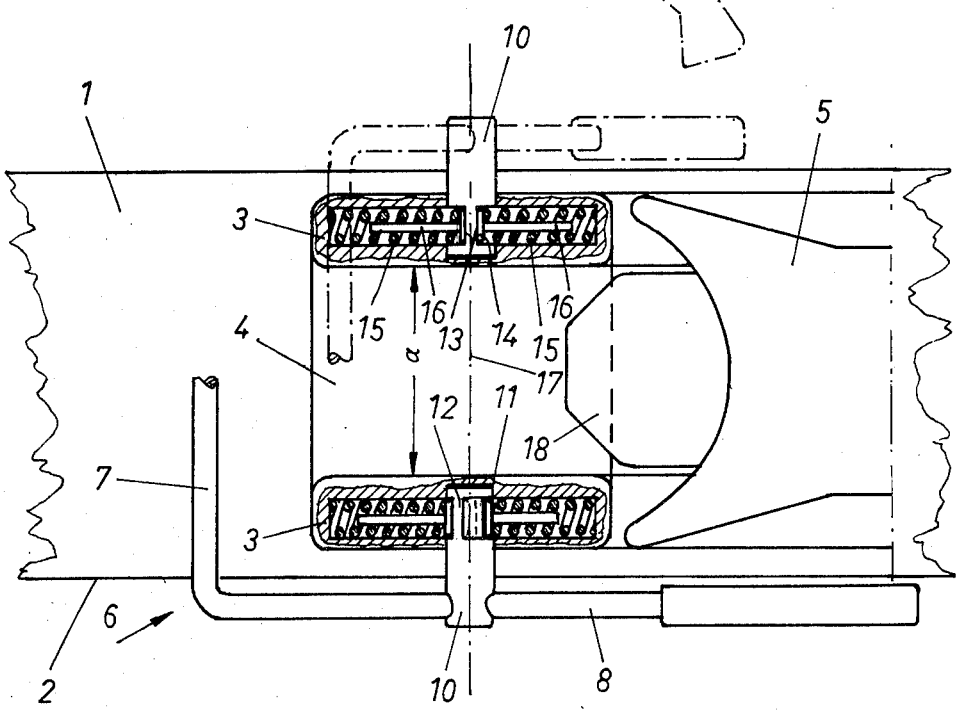
Figure 3:
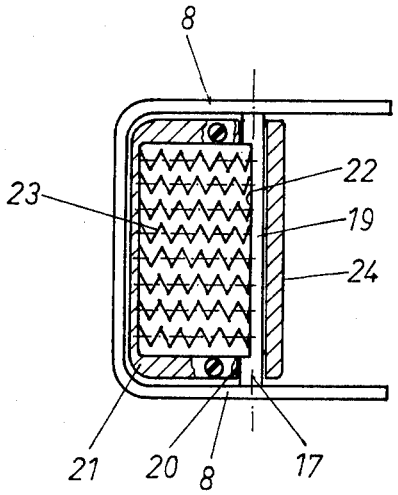

Additional advantages and features marking the invention may be gleaned from subsequent claims as well as from the following description and the drafts accompanying it showing various design modes faithfully embodying the invention. In the series of schematic representations the following is depicted:

FIG. 1: a side-view of an initial example illustrating one model implementing the invention;

FIG. 2: the bird's-eye view accompanying FIG. 1;

FIG. 3: an example of another design option embodying the invention, with part of a bird's view shown.

Holding devices (3) have been screwed onto the ski (1) near the surfaces alongside the ski (2). The holding devices may be limked via a shared base plate (4) upon which in the case of this model the heel grip (5) rests as well.

The braking guard-bar (6) is roughly U-shaped and consists of the bridge (7) and both arms (8). In each case it is depicted with solid lines in the go position where it lies approximately level, with its arms close to the side surface of the ski (2). The guard-bar in the braking position, on the other hand, is shown via dotted lines. In that mode the arms are inclined backward/downward at an angle of $\alpha$ which, in relation to straight up (9), preferably would measure 30°. As can be seen, in this braking position the arms (8) extending beneath the underside of the ski exert a braking force.

In the case of the model shown in FIGS. 1 and 2, two shaft stubs (10) have been so attached or riveted to the arms (8) as to make the stubs torsion-resistant. The stubs are so anchored in recesses or drilled moorings (11) in the holding devices as to allow them to be swiveled. That part (12) of each shaft stub protruding into the holding device is fitted with two abutment surfaces running parllel to each other (13), with the counter surfaces (14') of the piston (14) taking hold there, each of the latter in turn being subject to pressure from a spring (15). The springs (15) are braced at their other extremity against the holding devices. The coils run in the direction of the length of the ski, as do the holding devices. In the preferred model design implementing the invention they are shaped in the form of spiral coils. Protruding into them is a guide pin (16) from each respective piston, attached to that side of the piston opposite from the piston surface (14). Coils other than the spiral kind shown could also be used. The same applies to the model remaining to be described, namely, the one depicted in FIG. 3.

As the illustration shows, the guard-bar (6) may be swiveled around the level axis (17) running at a right angle to the length of the ski, thus being done against the action of the coils (15). The arrangement and the angle of inclination of the surfaces (13) vis-à-vis the arms (8) now is such that the pressure of the springs (8) induces the guard-bar to swivel into the braking position where the pistons (14) with their forward surfaces lie flush against the abutment surfaces (13). The boot, once it is placed on the braking guard-bar, presses down on the bridge as shown by the arrow in FIG. 1, swiveling the guard-bar against the action of the coils (15) around the axis (17). This leads the abutment surfaces (13) to assume approximately the position indicated in FIG. 1 by dotted lines, where said surfaces compress the coils (15) (see also what is shown in the bottom half of FIG. 2). Once the boot (1) is lifted off the ski, the coils via the abutment surfaces and the intermediary pieces in the form of pistons that automatically bring about swiveling of the guard-bar into the braking position as already explained.

As will be seen, the entire spring assembly thus is confined to a relatively narrow area close to the side surfaces of the ski (2). This makes it possible for the gap between the mutually facing sides of the holding devices to be so big as to allow the stepping spur (18) of the heel grip, or, if desirable, the heel grip itself, to be inserted into this gap between the holding device.

Visible also is the fact that in the braking position the torque brought to bear by the piston (14) pushed by the spring (15) down onto the preferably level abutment surface (13), is at its peak. The reason is that in the mode in question the abutment surfaces (13) run at a right angle to the vertical axis of the springs (15) so that the outer edges (13') of the abutment surfaces are farthest away from the vertical axis of the springs. In the go position, on the other hand (see also FIG. 1), the separation between the edges (13') and the vertical axis of the springs is much less, causing a drop in the torque exerted by the coils on the guard-bar despite the compression of the coils.

In the model shown in FIG. 3 both arms are linked in torsion-resistant fashion via a shaft (19). The shaft is anchored but free to turn inside moorings (10) drilled into a holding device. The forward-looking side of the shaft (19) is fitted with an abutment surface (22) which preferably also is level. Between this abutment surface (22) and the forward position of the holding device (21) pressure springs (23) are braced, in this example squeezing directly down on the abutment surface (22). In other respects, the example shown in FIGS. 1 and 2 has already illustrated the underlying principle and the modus operandi of this model. The design format shown in FIG. 3 is distinguished by especially flat construction, i.e. the unit height b is still less than that in the case of the model depicted in FIGS. 1 and 2. In this example, the stepping-spur of the heel grip can be slid as far as the back surface (24) of the holding device (21).

Side-type standing ridges or the side portions of a heel grip could also double as holding devices (not shown). It is thus also possible to unite with the base plate (4) the combination of a brake true to the invention with the heel grip and, if desired, with a fast-action adjustment mechanism for this heel grip, all of which could be mounted on the ski as an independent unit.

What is claimed is:

1. Ski brake on a ski to be used with a ski boot comprising a base plate mounted on said ski;

a heel grip mounted on said base plate and having a stepping spur extending forwardly therefrom on an intermediate part of said ski;

a pair of hollow, elongated, juxtaposed holding devices, each device mounted between said stepping spur and an outer edge of said ski;

a pair of opposing springs mounted in each holding device;

a pair of separated stub shafts, each said stub shaft mounted respectively at approximately the midpoint of each said holding device;

each said stub shaft having a pair of parallel abutment surfaces for receiving thereagainst an individual end of an opposing spring when each said stub shaft is in a first position for braking action;

a U-shaped braking guide bar comprising arms extending to be mounted respectively at an intermediate point thereof in each stub shaft, and each arm extending further beyond each said stub shaft to provide said braking action; and said stub shafts movable into a second position when said ski boot presses down on said guard bar to rotate said stub shafts and move said abutment surfaces out of contact with said ends of said opposing springs and move said extending arms out of said braking position.

2. Ski brake according to claim 1 wherein said end of each opposing spring comprises a piston surface from which a guide pin extends into said spring, and each said piston surface is flush with one of said abutment surfaces when the ski brake is in said braking position.

* * * * *